US006092733A

United States Patent [19]

Watanabe et al.

[11] Patent Number: 6,092,733

[45] Date of Patent: Jul. 25, 2000

[54] EXPANSION VALVE

[75] Inventors: Kazuhiko Watanabe; Masamichi Yano, both of Tokyo, Japan

[73] Assignee: Fujikoki Corporation, Tokyo, Japan

[21] Appl. No.: 09/038,954

[22] Filed: Mar. 12, 1998

[30] Foreign Application Priority Data

Mar. 27, 1997 [JP] Japan ..... 9-075444

[51] Int. Cl.[7] ..... G05D 27/00

[52] U.S. Cl. ..... 236/92 B; 62/225

[58] Field of Search ..... 62/235; 236/92 B

[56] References Cited

U.S. PATENT DOCUMENTS

| | | | |
|---|---|---|---|
| 138,562 | 5/1873 | Hayes . | |
| 649,159 | 5/1900 | Carroll . | |
| 828,597 | 8/1906 | Cowles . | |
| 2,669,011 | 2/1954 | Brumbaugh | 29/157.1 |
| 3,283,776 | 11/1966 | Flanagan et al. | 137/301 |
| 3,566,905 | 3/1971 | Noland | 137/209 |
| 5,228,619 | 7/1993 | Yano et al. | 236/92 B |
| 5,303,864 | 4/1994 | Hirota | 236/92 B |
| 5,361,597 | 11/1994 | Hazime et al. | 62/205 |
| 5,433,246 | 7/1995 | Horton | 137/565 |
| 5,597,117 | 1/1997 | Watanabe et al. | 236/92 B |
| 5,826,438 | 10/1998 | Ohishi et al. | 62/199 |

FOREIGN PATENT DOCUMENTS

| | | |
|---|---|---|
| 0 659 600 | 6/1995 | European Pat. Off. . |
| 0 762 063 | 3/1997 | European Pat. Off. . |
| 9-26235 | 1/1997 | Japan . |

OTHER PUBLICATIONS

Patent Abstracts of Japan; Kimimichi; "Expansion Valve"; vol. 097, No. 005; (May 30, 1997); Japanese No. 09 026235, (Jan. 1997).

*Primary Examiner*—Henry Bennett
*Assistant Examiner*—Mark Shulman
*Attorney, Agent, or Firm*—Foley & Lardner

[57] ABSTRACT

A hollow extrusion device includes a piston for pushing a billet of aluminum alloy through a first molding die placed on an opposite side of the billet. The molding die may comprise any number of cavities, but preferably comprises three cavities. On a side of the first die from which the extruded billet exits, a second die is provided and forms an outer shape of the expansion valve body. Subsequent to passing through the second die, mandrels are provided which form penetrating holes in the extruded, shaped material. One mandrel forms a second path in the expansion valve body, and two other mandrel form two bolt holes in the expansion valve body. The extruded, shaped material is cut to a set length, then further processed.

9 Claims, 8 Drawing Sheets

EXPANSION VALVE

TECHNICAL FIELD OF THE INVENTION

The present invention relates to a thermal expansion valve for use in an air conditioning device of a vehicle and the like wherein the flow rate of the refrigerant supplied to the evaporator is controlled in correspondence with the temperature of the refrigerant passing the evaporator of a refrigeration cycle.

BACKGROUND OF THE INVENTION

FIGS. 9 and 10 are a vertical cross-sectional view and a side view showing the concept of an expansion valve 10 of the prior art. In FIG. 9, the inner structure is omitted. A substantially rectangular solid-shaped valve body 30 of a thermal expansion valve comprises a refrigerant path 11 of a refrigeration cycle, and a first path 32 through the valve body 30 which extends from a refrigerant exit of a receiver 6 (which is preceded in the refrigerant path 11 by a condenser 5) to a refrigerant entrance of an evaporator 8, and a second path 34 through the valve body 30 which extends from a refrigerant exit of the evaporator 8 to a refrigerant entrance of a compressor 4 which is in the refrigerant path 11. The first path 32 and the second path 34 are formed so that one path is on top of the other path with a distance in between.

A valve hole 32*a* is formed in the first path 32 for the adiabatic expansion of a liquid refrigerant supplied from the refrigerant exit of the receiver 6. The valve hole 32*a* has a center line along a longitudinal direction of the valve body 30. A valve seat is formed in the entrance of the valve hole 32*a*. A valve member 32*b* is supported by a support member 32*d* in the valve seat, and is biased with the supporting member 32*d* by a biasing means 32*c*, for example a compression coil spring or the like.

The first path 32 comprises an entrance port 321 to which the liquid refrigerant from the receiver 6 is introduced and an exit port 322 for supplying the refrigerant to the evaporator 8. The valve body 30 includes the entrance port 321 and a valve chamber 35 connected to the entrance port 321. The valve chamber 35 is a chamber with a bottom formed on the same axis as a center line of the valve hole 32*a*, and is sealed by a plug 37.

On the upper end of the valve body 30, a valve member driving device 36, which comprises a heat sensing portion for driving the valve member 32*b*, is mounted by a screw. The valve member driving device 36 has a pressure activation housing 36*d* whose inner space is divided into an upper pressure activation chamber 36*b* and a lower pressure activation chamber 36*c* by a diaphragm 36*a*.

The lower pressure activation chamber 36*c* inside the pressure activation housing 36*d* is connected to the second path 34 through a pressure hole 36*e* formed in a concentric manner with the center line of the valve hole 32*a*.

A vaporized refrigerant passing through the evaporator 8 enters the second path 34 from the refrigerant exit. The path 34 is a path for gas-phase refrigerant, wherein the pressure of the vaporized refrigerant enters the lower pressure activation chamber 36*c* through the pressure hole 36*e*.

A valve member driving shaft 36*f* penetrating the second path 34, and extending from a lower surface of the diaphragm 36*a* to the valve hole 32*a* in the first path 32, is positioned in a concentric manner with the pressure hole 36*e*. The valve member driving shaft 36*f* comprises on its upper end a stopper portion 36*fl* which contacts the lower surface of the diaphragm, and is supported so as to be able to slide upward and downward along an inner surface of the lower pressure activation chamber 36*c* of the pressure activation housing 36*d* and along a wall which separates the first path 32 and the second path 34 in the valve body 30. The lower end of the valve member driving shaft 36*f* contacts the valve member 32*b*. In an outer peripheral area of the separation wall which serves as a guide hole for the valve member driving shaft 36*f*, a sealing member 36*g* is mounted to prevent leaking of refrigerant from the first path 32 to the second path 34.

The upper pressure activation chamber 36*b* of the pressure activation housing 36*d* is filled with a known heat sensing gas for driving diaphragms. The valve member driving shaft 36*f* is exposed in the pressure hole 36*e* and in the second path 34 to the temperature of the refrigerant passing through the second path 34 from the evaporator 8 to the compressor 4. The valve member driving shaft 36*f* acts as the heat sensing shaft and assumes the temperature of the refrigerant passing through the valve. This temperature assumed by the valve member driving shaft 36*f* is transmitted to the uppermost portion of the shaft 36*f*, including the stopper 36*fl*, and therefore to the pressure activation housing 36*d*. This temperature transmitted to the pressure activation housing 36*d* causes the gas in the upper pressure activation chamber 36*b* to expand or contract accordingly. A tube 36*h* is utilized for filling the upper pressure activation chamber 36*b* with heat sensing gas, and is closed after the filling.

A diaphragm driving fluid (heat sensing gas) inside the upper pressure activation chamber 36*b* turns into gas in correspondence with the heat transmitted thereto, and applies pressure to an upper surface of the diaphragm 36*a*. The diaphragm 36*a* deforms in the upward or downward direction according to a difference in pressure applied to a top surface of the diaphragm from the upper chamber 36*b* and pressure applied to the lower surface of the diaphragm 36*a*.

Displacement of the diaphragm 36*a* in the upward or downward direction is transmitted to the valve member 32*b* through the valve member driving shaft 36*f*, and moves the valve member 32*b* away from or toward the valve seat of the valve hole 32*a*, respectively. As a result, the flow of refrigerant passing through the valve hole 32*a* is controlled.

As is shown in FIG. 10, two bolt holes 50 are formed in the valve body 30. These bolt holes are used to mount the expansion valve and a corresponding member.

The valve body 30 having the above structure is manufactured by extruding aluminum alloy and adding mechanical processing, such as machining, thereto.

The first path 32 has a complex structure including two separate path sections, an orifice, and a valve chamber 35 within the valve body 30. The second path 34 has a simple structure including only a passage for the gas-phase refrigerant to pass from the evaporator 8 to the compressor 4. Therefore, the second path 34 can be processed as a straight penetrating hole.

Further, the two bolt holes 50 need only comprise a simple passage for the bolt to pass through.

The present invention provides an expansion valve whose valve body is manufactured in a simplified manner by using a hollow extrusion processing.

SUMMARY OF THE INVENTION

The expansion valve of the present invention transmits a temperature of a refrigerant passing from the evaporator to the compressor through a path formed by a hollow extrusion processing in a valve body having a substantially prismatic shape. The expansion valve of the present invention controls a flow of refrigerant supplied from a condenser to the evaporator through a path formed in the valve body, the flow of refrigerant is controlled according to a change in pressure of a heat sensing gas inside a pressure activation chamber.

More particularly, the expansion valve of the present invention comprises a first path through which a refrigerant passes from a condenser to an evaporator, a second path through which refrigerant passes from the evaporator to a compressor. The valve body has a substantially prismatic shape and has two bolt holes for mounting. A valve hole is formed in the first path. A valve member is seated in the valve hole and diaphragm is mounted in the valve body. A valve member driving shaft has one end fixed to the diaphragm and another end contacting the valve member. A flow of refrigerant passing through the valve hole in the first path is adjusted according to the temperature of the refrigerant flowing through the second path. The valve body is manufactured by having at least one of the second path or the two bolt holes formed by a hollow extrusion processing.

Further, the expansion valve of the present invention comprises, on the valve body, a first entrance into which refrigerant from the condenser flows, a first exit supplying refrigerant to the evaporator, a second entrance into which refrigerant flows from the evaporator, and a second exit connected to the second entrance which supplies refrigerant to the compressor. A valve is mounted in a port portion connecting the first entrance and the first exit. A heat sensing portion is mounted between the second entrance and the second exit, and senses a temperature of refrigerant flowing from the second entrance to the second exit. The flow of refrigerant flowing from the first entrance to the first exit is controlled by a heat sensing portion which drives the valve. A portion of the valve between the second entrance and the second exit is formed by a hollow extrusion processing.

In a preferred embodiment of the present invention, the valve body comprises an aluminum material.

In an expansion valve having the above-explained structure, a first path and a second path are formed in the valve body. A refrigerant passing through the evaporator toward the compressor flows in the second path, and the temperature of the refrigerant flowing through the second path is sensed by a heat sensing portion. According to a change in the temperature, the flow rate of refrigerant passing through the first path from the condenser to the evaporator is adjusted by a valve. The second path of the valve body is formed by a hollow extrusion processing, so the second path can be processed at the same time as the valve body without the need for machining a hole- Thus, a processing step is omitted.

DETAILED DESCRIPTION OF THE PREFERRED EMBODIMENTS

Figure 1:
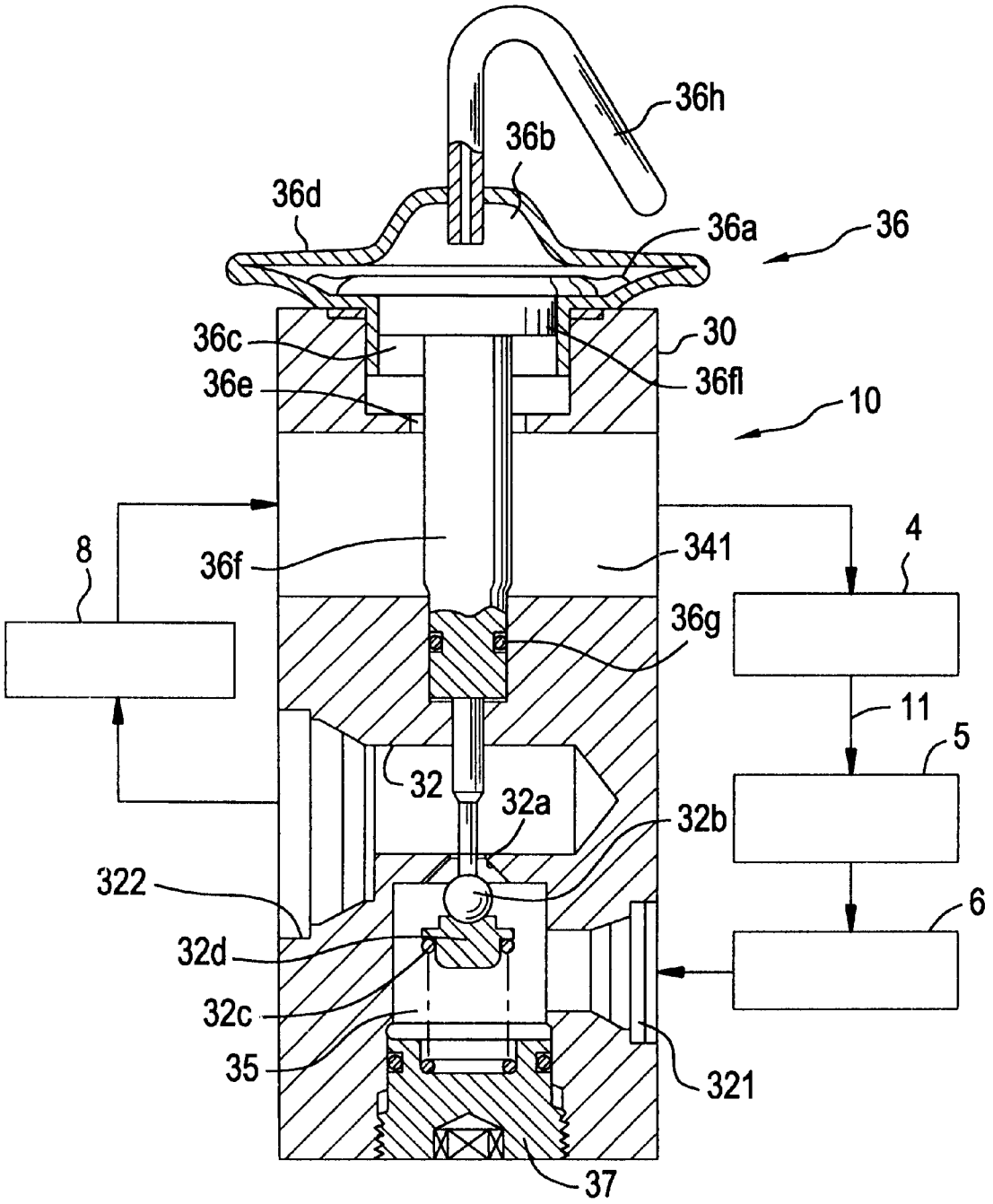
FIG. 1 is a vertical cross-sectional view showing one embodiment of an expansion valve of the present invention.
Figure 9:
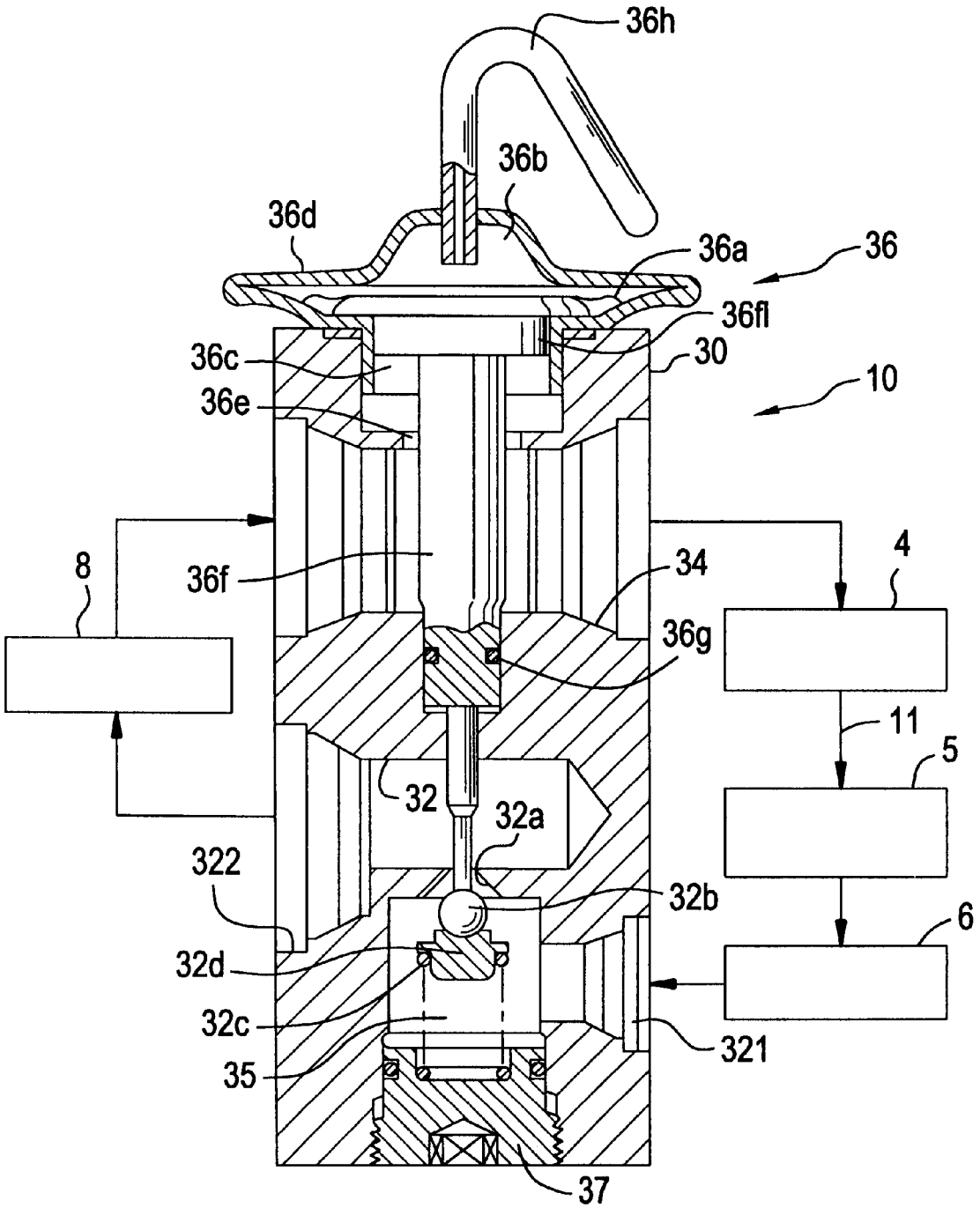
FIG.9 PRIOR ART
FIG. 9 is a vertical cross-sectional view explaining an expansion valve of the prior art.
Figure 10:
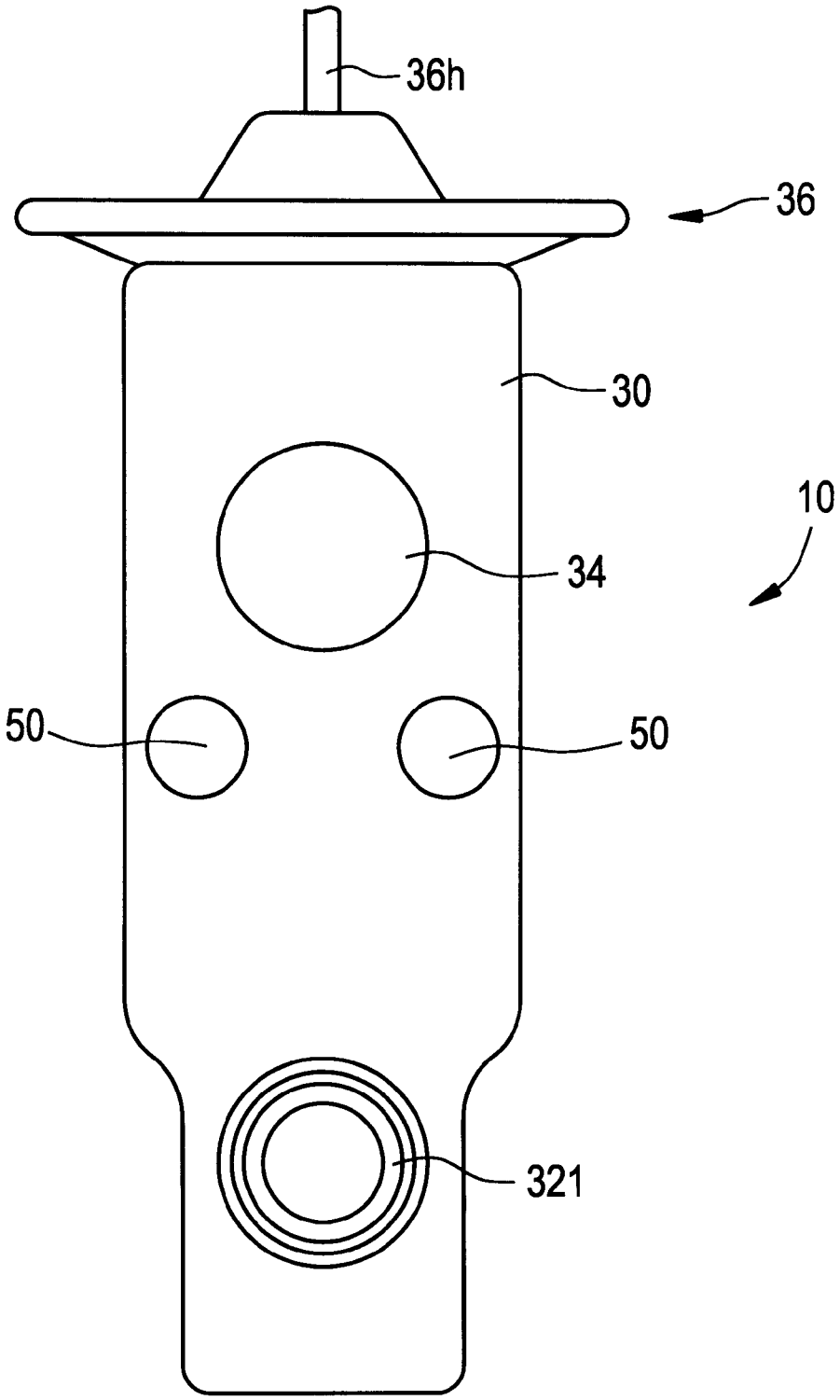
FIG. 10 PRIOR ART
FIG. 10 is a side view of the prior art expansion valve shown in FIG. 9.

FIG. 1 is a vertical cross-sectional view showing one embodiment of an expansion valve of the present invention. The structure and operation of the present expansion valve is the same as that shown in FIG. 9. However, FIG. 1 is characterized by the fact that the second path 341 is formed by a hollow extrusion processing, which differs from the machined second path 34 of FIG. 9. Therefore, in the expansion valve shown in FIG. 1, the second path and the two bolt holes in the valve body were formed by a hollow extrusion processing, and the areas near the entrance and exit of the second path are provided with additional mechanical processing, such as machining, after hollow extrusion processing.

Figure 2A:
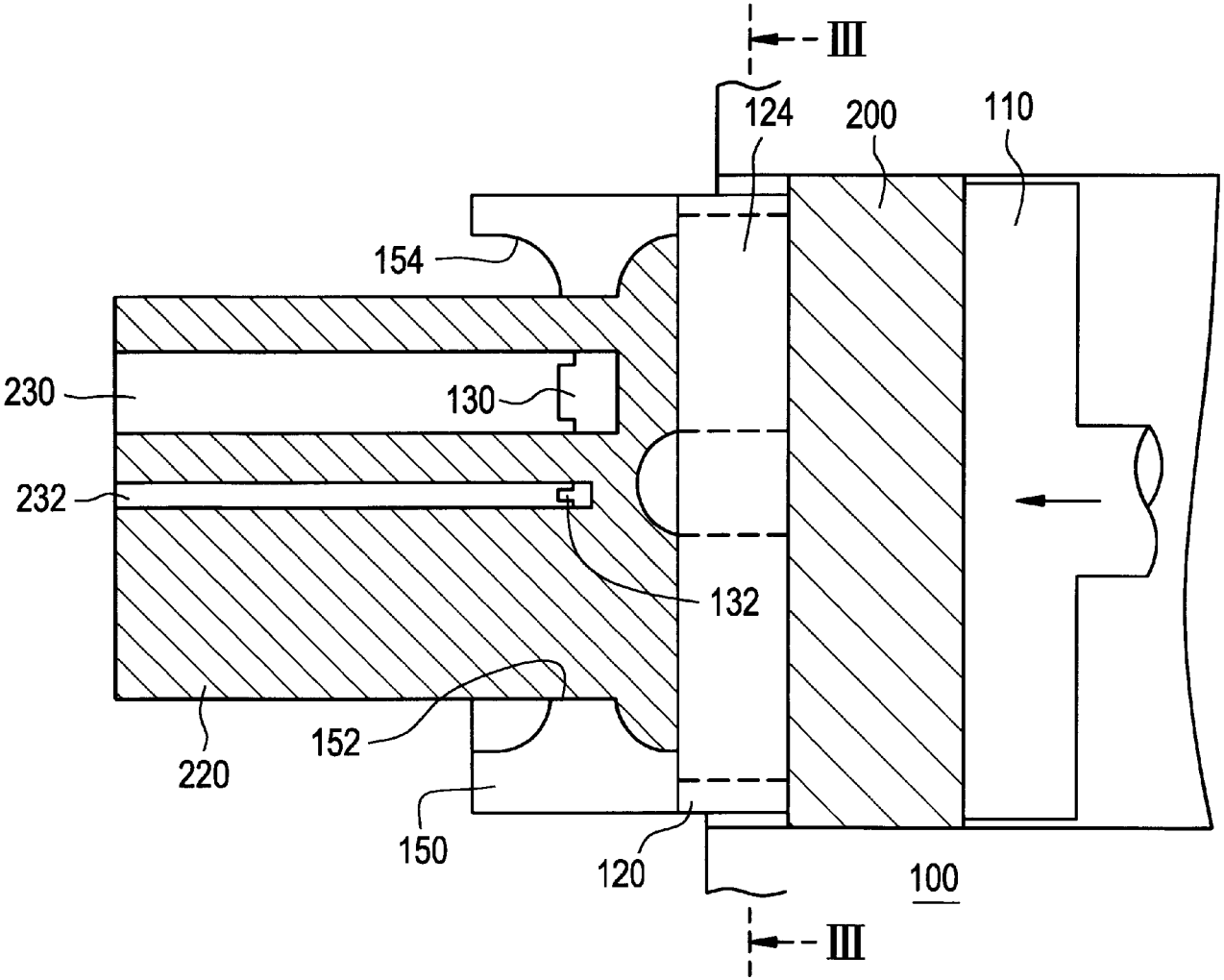
FIGS. 2A and 2B are explanatory views showing a concept of a manufacturing device of the expansion valve body according to the present invention.
Figure 2B:
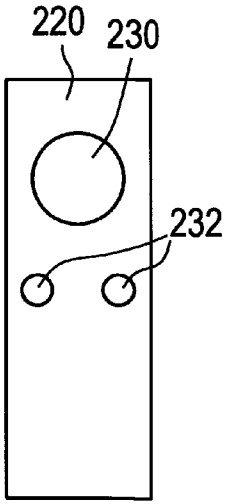
Figure 3:
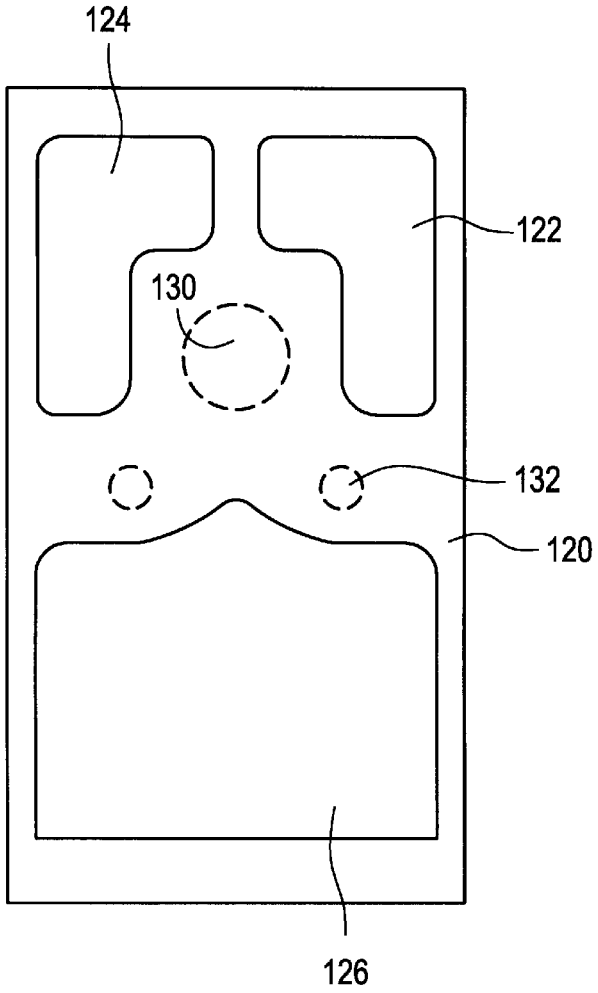
FIG. 3 is a cross-sectional view taken along line III—III of FIG. 2A.
Figure 4:
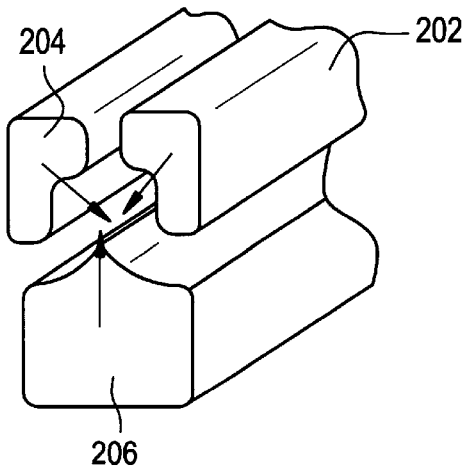
FIG. 4 is an explanatory view showing hollow extrusion processing.
Figure 5:
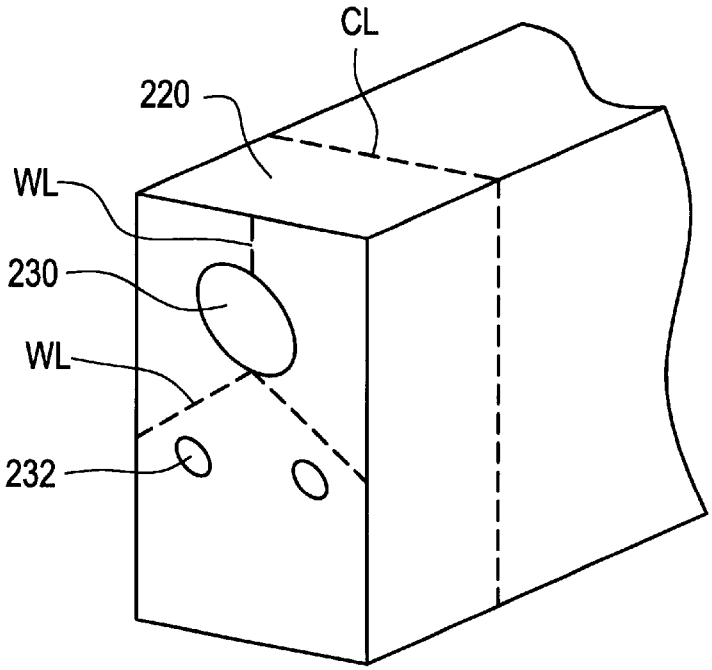
FIG. 5 is a schematic view of the material formed by hollow extrusion processing.

FIGS. 2A and 2B show explanatory schematic views of a manufacturing device for a valve body of the present invention. FIG. 3 is a cross-sectional view taken along line III—III of FIG. 2A. FIG. 4 is an explanatory view of hollow extrusion processing. FIG. 5 is a schematic view of the molded valve body material.

Referring to FIGS. 2A and 2B, a hollow extrusion device 100 comprises a piston 110 for pushing a billet 200 made of aluminum alloy.

The first molding die 120 comprises cavities 122, 124 and 126 for extruding the pushed billet 200 into member 202, 204 and 206, respectively. In the shown device, three cavities 122, 124 and 126 are included, but any design and number of openings could be used according to a desired shape of the molded element.

At an exit side of the first molding die 120, mandrels 130 and 132 are provided. The mandrels 130, 132 form a penetrating hole in the valve body as the molded member exits the first molding die 120.

The mandrel 130 forms a path in the valve body 30. The two mandrels 132 form two bolt holes.

Second molding dies 150 and 154, positioned at the exit side of the first molding die 120 form an outside shape of the product.

FIG. 4 is an explanatory view showing the status of the member extruded from a cavity of the first die 120. Three members 202, 204 and 206 are extruded to a shape corresponding to the shape of the cavity. FIG. 5 is an explanatory view showing the status of the member extruded from the second die 150 after penetration by mandrels 130 and 132. The mandrels penetrate holes in the outer shape of members 202, 204 and 206 when the members 202, 204 and 206 are squeezed through an opening 152 of the second die 150 in an inward direction (see arrows in FIG. 4). A member 220 exits the second die 150 as a single unit with the three members 202, 204 and 206 contacting each other along welding lines WL.

The valve body material 220 extruded from the second die 150 comprises a large penetrating hole 230 which is a second path, and smaller penetrating holes 232 which are two bolt holes.

A material of a single valve body is sectioned off by cutting the long member 220 emerging from die 150 at a cutting line CL.

Figure 6:
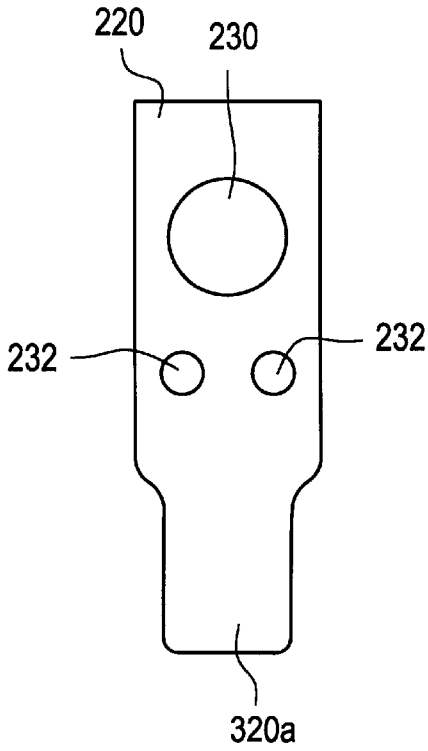
FIG. 6 is a side view showing another embodiment of the expansion valve according to the present invention.

As explained above, during hollow extrusion processing an outside shape of the manufactured product can be changed as desired by changing a shape of the second die 150. Therefore, as is shown in the embodiment of FIG. 6, a smaller product could he obtained by forming the material 220 of the valve body of the expansion valve to have a decreased width at a lower portion 320*a*. In such material 220, the size of the large penetrating hole 230 (the second path) and the small bolt holes 232 and their position are the same as that of the embodiment of FIG. 1.

In the above embodiment, the second path and the two bolt holes are formed by hollow extrusion processing. However, the present invention is not limited to such embodiment, and either the bolt holes or the second path alone could be formed by hollow extrusion processing.

Figure 7:
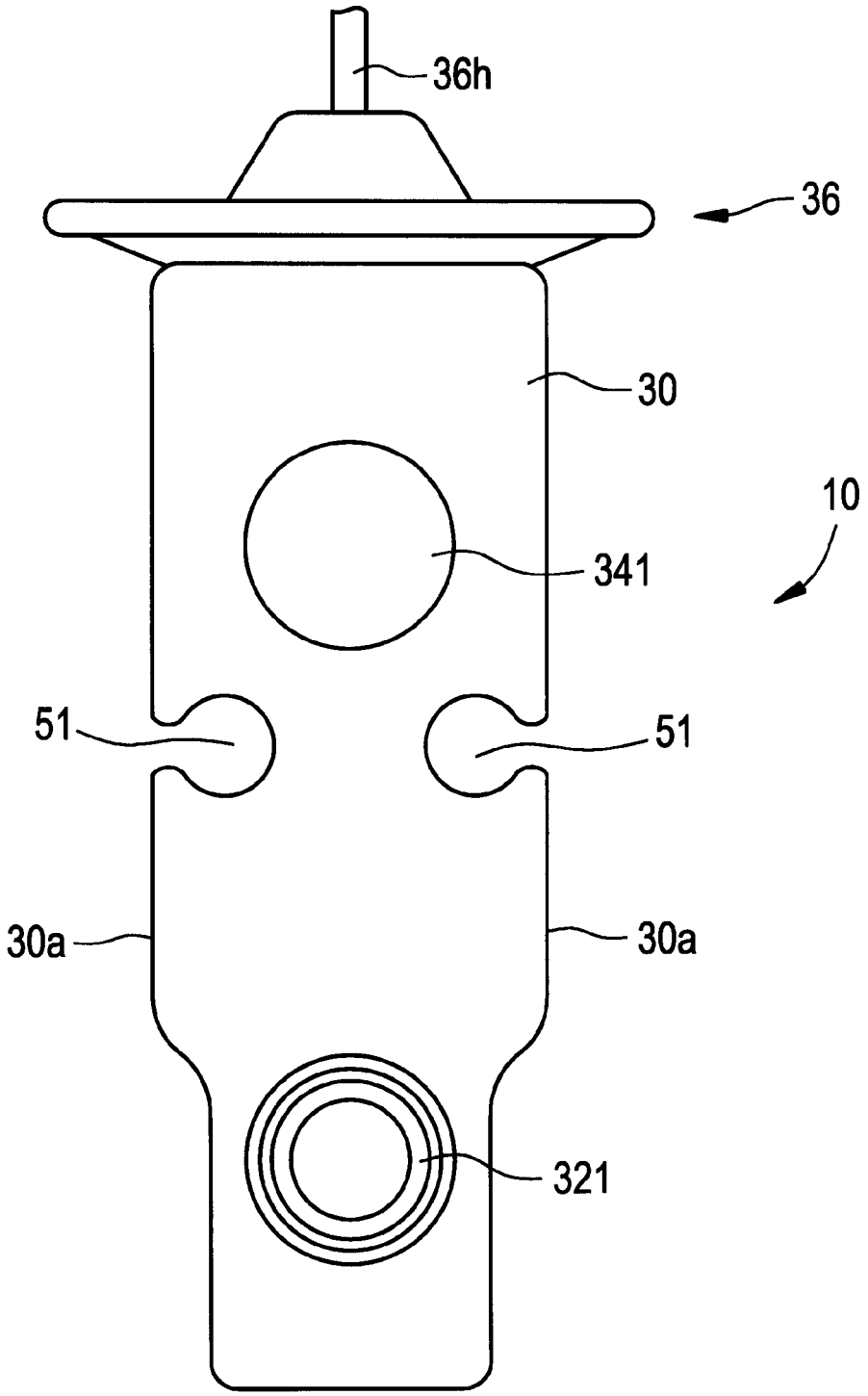
FIG. 7 is a side view showing yet another embodiment of the expansion valve according to the present invention.
Figure 8:
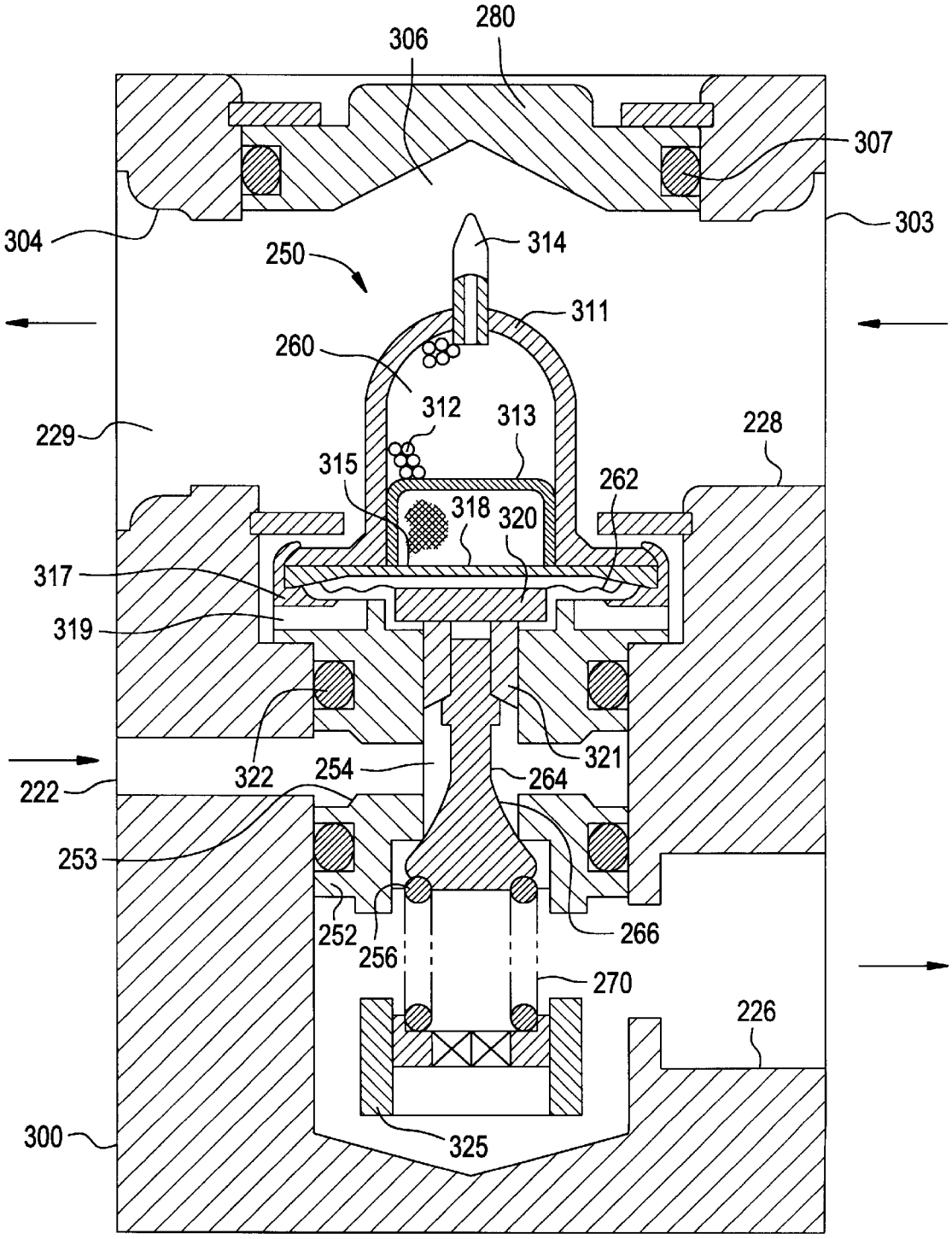
FIG. 8 is a vertical cross-sectional view showing yet another embodiment of the expansion valve according to the present invention.

Further, in the present invention, when forming bolt holes by hollow extrusion processing, the holes can be formed either as penetrating holes as in the previous embodiment, or as grooves formed on both sides of the valve body (see FIG. 7). FIG. 7 is a side view showing another embodiment of the present invention. The bolt holes 51 are formed as grooves positioned on both sides of the valve body 30. In FIG. 7, the valve body 30 is shown to have a narrow width size at a lower portion as was shown in FIG. 6. Its structure and operation are the same as the expansion valve shown in FIG. 1, but FIG. 8 is characterized in that grooves 51 are formed on both sides 30*a* of the valve body 30 as bolt holes by the hollow extrusion processing. Further, the grooves 51 can be formed at the same time as the second path 341 or either of them could be formed alone.

FIG. 8 is a vertical cross-sectional view showing yet another embodiment of the expansion valve of the present invention. The basic structure of this box-type expansion valve is laid-open in Japanese Patent Publication No. H5-71860. In the drawing, a block case 300 constitutes the valve body and comprises an entrance 222 of a path through which liquid-phase refrigerant flows from a condenser (not shown), an exit 226 for supplying refrigerant to an evaporator (not shown), an entrance 303 of a path 228 through which gas-phase refrigerant flows, and an exit 304 of the path 228 through which gas-phase refrigerant returns to the compressor (not shown). The arrows in the drawing show the direction of flow of refrigerant.

In the embodiment of FIG. 8, the block case 300 includes a path 229, connecting the entrance 303 and the exit 304, which is formed by hollow extrusion processing. Mechanical processing, such as machining, is added to an end surface of the exit 304 after the path 229 is formed.

The block case 300 comprises, for example, an aluminum alloy. A plug 280 acts as a lid for sealing a hole in the block case 300. A concavity 306 is shaped and sized to permit mounting of a valve unit 250 for operating an expansion valve inside the block case 300. Sealing of the plug 280 is provided by an o-ring 307. The valve unit 250 comprises a power element portion 260, a valve member 264 with a tapered portion 266, and a bias spring 270. The power element portion 260 is placed inside the path 229, and activated carbon 312 is sealed inside a heat sensing portion formed by a power element case 311 and a bottom plate 315. A refrigerant which is either the same as or shows the same characteristics as the refrigerant in the refrigeration cycle is introduced via a pipe 314 into the heat sensing portion as a heat sensing gas. Pipe 314 is subsequently sealed. Since the activated carbon is placed inside the flow path of the refrigerant, a wire net 313 is placed so that a gas introduction opening 318, positioned in the center portion of the bottom plate 315, will not be covered by the activated carbon. The amount of activated carbon is adjusted. Further, in the area between the bottom plate 315 and a diaphragm receiver 317, a diaphragm 262 is positioned. A periphery of the diaphragm 262 and a periphery of the power element case 311 are held in place by the diaphragm receiver 317, and are sealed by soldering.

The diaphragm 262 comprises, for example, stainless steel material.

A corrugate is formed in the peripheral area of the diaphragm 262 so that a certain flexure can be obtained in response to a change of pressure inside the power element portion 260. An amount flexure $\sigma$ of the diaphragm is determined by a pressure difference $\Delta P$ between a pressure $P_B$ inside the power element portion 260 which is applied to an upper surface of the diaphragm 262, and a pressure $P_L$ of refrigerant flowing from the entrance 303 toward the exit 304 of path 229 which is applied to a lower surface of the diaphragm 262 through a pressure hole 319. A force $F_1$ which pushes the valve member 264 in a downward direction is decided by $\sigma$ and thus by $\Delta P$.

The bottom plate 315 is provided to limit deformation of the diaphragm 262 in an upward direction. A stopper 320 is provided to limit deformation of the diaphragm 262 in a downward direction. The force $F_1$ is transmitted from the diaphragm 262 to the valve member 264 through the stopper 320 and a collar 321.

A bellows seal 322 is provided to keep high-pressure liquid-phase refrigerant from flowing from the liquid-phase refrigerant entrance 222 into the pressure hole 319 and the path 229. The collar 321, the bellows seal 322 and the valve member 264 are formed as a unit which is slidably positioned in a center hollow portion of a body 252. A high-pressure liquid pathway is provided between the liquid-phase refrigerant entrance 222 and the center hollow portion of the body 252. Further, a lower portion of the body 252 is equipped with a lower hollow portion 256 having a larger diameter than the center hollow portion. A lower portion of the center hollow portion constitutes a valve port 254. A bias coil spring 270 is placed inside the lower hollow portion 256, and a bias spring force is adjusted by an adjustment screw 325.

The activated carbon 312 in the power element portion 260 senses a temperature of the refrigerant flowing from the refrigerant gas entrance 303 through the power element case 311 to the refrigerant gas exit 304. This temperature corresponds to a super-heated vapor temperature of the refrigerant, and the pressure corresponding to the temperature becomes the pressure $P_B$ inside the power element by adsorption equilibrium. On the other hand, $P_B - P_L = \Delta P$, and the force $F_1$ related to the flexure $\sigma$ of the diaphragm 262 becomes the force for pushing the valve member 264. Thus, the degree of opening of the valve is determined by the bias of coil spring 270 and a fluid force decided by a shape of the valve. The degree of opening of the valve controls a flow rate of refrigerant flowing from the liquid-phase refrigerant entrance 222 to the refrigerant exit 226.

The present invention forms the valve body of the aforementioned expansion valve having a substantially prismatic shape using extrusion processing. The valve body of the expansion valve comprises a straight hole for the refrigerant passing from the evaporator toward the compressor, and two bolt holes formed parallel to the straight hole. Therefore, by hollow extrusion processing, these holes are formed in a unit, omitting the mechanical processing step which was necessary in the prior art after molding. Using hollow extrusion processing, the amount of aluminum material need to create a valve body could be lessened, and a cost-effective expansion valve could be gained. Japanese Application JP H9-75444, filed Mar. 27, 1997, is incorporated herein, in its entirety, by reference.

What is claimed is:

1. An expansion valve for use with a refrigerant adapted to flow at least through an evaporator and a compressor, and having a heat sensing portion and a heat sensing shaft, the heat sensing portion having a heat sensing gas and the temperature of the refrigerant transmitting to the heat sensing portion through the heat sensing shaft, wherein the valve has a first path through which the refrigerant from the evaporator to the compressor communicates and a second path through which the refrigerant from the condenser to the evaporator communicates, wherein the expansion valve controls the flow rate of the refrigerant flowing through the second path based on the change of pressure of the heat sensing gas inside the heat sensing portion, the expansion valve comprising:

a substantially prismatic-shaped valve body having the first and second paths, wherein at least the first path is formed by a hollow extrusion, and wherein the valve body comprises an aluminum.

2. An expansion valve comprising:

a substantially prismatic-shaped valve body having two bolt holes;

a diaphragm mounted to the valve body;

a first path extending through the valve body and adapted to flow a refrigerant to an evaporator;

a second path extending through the valve body and adapted to flow the refrigerant from the evaporator to a compressor;

a valve hole in the first path;

a valve member movable to and away from the valve hole to control the refrigerant flow in the first path; and a valve member driving shaft having one end connecting to the diaphragm and the other end supporting the valve member, wherein a flow rate of the refrigerant flowing through the valve hole is adjusted corresponding to a temperature of refrigerant flowing through the second path, wherein at least the second path is formed by a hollow extrusion, and wherein the valve body comprises an aluminum material.

3. An expansion valve comprising:

a substantially rectangular-shaped valve body;

a first entrance formed in the valve body and adapted to receive a refrigerant from a condenser;

a first exit formed in the valve body and adapted to supply the refrigerant to an evaporator:

a second entrance in the valve body and adapted to receive the refrigerant from the evaporator;

a second exit communicating with the second entrance and adapted to supply the refrigerant to a compressor;

a port portion formed between the first entrance and the first exit and communicating the first entrance and the first exit;

a valve member movable to and away from the port portion to control the flow of the refrigerant between the first entrance and the first exit; and a heat sensing portion positioned between the second entrance and the second exit and senses the temperature of refrigerant flowing from the second entrance to the second exit, wherein the heat sensing portion adjusts the flow rate of the refrigerant flowing from the first entrance to the first exit, wherein the second entrance and the second exit of the valve body is formed by a hollow extrusion, and wherein the valve body comprises an aluminum.

4. An expansion valve for controlling flow of a refrigerant between a compressor and an evaporator, comprising:

a substantially prismatic-shaped valve body made of an extrudable material, the valve body having a passageway adapted to pass the refrigerant between the evaporator and the compressor, wherein the passageway is formed by a hollow extrusion.

5. An expansion valve according to claim 4, wherein the valve body is formed by a hollow extrusion.

6. An expansion valve according to claim 5, wherein the valve body is made of aluminum.

7. An expansion valve for controlling flow of a refrigerant between a compressor and an evaporator, comprising:

a substantially prismatic-shaped valve body made of an extrudable material, the valve body having a passageway adapted to pass the refrigerant between the evaporator and the compressor, and bolt holes for mounting the expansion valve, wherein the passageway and the bolt holes are formed by a hollow extrusion.

8. An expansion valve according to claim 7, wherein the valve body is formed by a hollow extrusion.

9. An expansion valve according to claim 8, wherein the valve body is made of aluminum.

* * * * *